United States Patent [19]

Joseph

[11] 4,057,924

[45] Nov. 15, 1977

[54] RIFLE BARREL STABILIZER

[76] Inventor: Robert P. Joseph, 805 Stark St., Austin, Tex. 78756

[21] Appl. No.: 738,749

[22] Filed: Nov. 4, 1976

[51] Int. Cl.[2] ..... F41C 27/00

[52] U.S. Cl. ..... 42/75 A

[58] Field of Search ..... 42/75 A, 75 B

[56] References Cited

U.S. PATENT DOCUMENTS

| | | | |
|---|---|---|---|
| 2,479,594 | 8/1949 | Yasho | 42/75 A |
| 2,589,912 | 3/1952 | Weld | 42/75 A |
| 2,841,909 | 7/1958 | Temple | 42/75 A |
| 3,060,612 | 10/1962 | Brown et al. | 42/75 A |

*Primary Examiner*—Charles T. Jordan

*Attorney, Agent, or Firm*—Howard E. Moore; Gerald G. Crutsinger; Larry B. Dwight

[57] ABSTRACT

A device for adjusting the force between the rifle barrel and the forearm of the stock comprising a stabilizing block having a concave groove formed on the upper surface thereof to engage the rifle barrel. An adjuster screw having an enlarged head is rotatably positioned in a socket formed in the lower side of the stabilizing block and retaining pins retain the head of the screw within the socket. A screw housing is rigidly secured within the stock close to the end of the forearm. The adjuster screw is threadedly secured to the screw housing such that the stabilizing block may be moved relative to the screw housing and forearm to adjust the force on the rifle barrel.

6 Claims, 4 Drawing Figures

RIFLE BARREL STABILIZER

BACKGROUND OF THE INVENTION

It is well known that the accuracy of a rifle is effected by the amount of force exerted between the barrel and the stock supporting the barrel. The bedding of the rifle barrel into the stock requires a great deal of skill to accurately control the force between the rifle and stock.

As the rifle is fired, harmonic vibrations are set up in the barrel which effect the accuracy of the rifle. These vibrations can only be controlled by adjusting the force exerted between the barrel and the forearm stock.

Usually, the rifle barrel is bedded into the stock under controlled weather conditions. As the weather changes, the wood has a natural tendency to change its density and often has a slight amount of warp. As the stock forearm changes in position relative to the rifle barrel, the force between the rifle barrel and stock forearm will be changed and therefore change the harmonic vibration patterns and the accuracy of the rifle by changing the trajectory of the bullet.

In addition to weather changes, different cartridge loads will react differently within certain rifles and it is desirable to change the force between the barrel to compensate for different loads to produce the smallest size group of shots on the target.

Devices heretofore devised to compensate for the force between the barrel and the rifle stock, such as that disclosed in U.S. Pat. No. 3,606,612, rely on spring steel posts and requires a large amount of inletting and holes to be drilled in the stock to accommodate the elongated type devices which have several parts and screws. These devices require a skilled craftsman to install and require that considerably more volume of wood be removed from the stock for installation, thereby reducing the strength of the forearm tip. In addition, the barrel support portion of the device does not make continous contact along the device which is desirable to prevent undue wear on the outside of the barrel.

SUMMARY

I have devised a simple device for controlling the force between the rifle and the forearm of the stock on the rifle. The rifle is bedded into the stock in the usual manner and the rifle barrel stabilizing device is located in the forearm of the stock within approximately one inch from the end thereof.

The stabilizer device comprises a stabilizer block having a longitudinal concave groove formed on the upper side thereof to engage the rifle barrel. The stabilizer block has a socket formed therein to receive an adjusting screw. The adjusting screw has a large head formed on the upper end to form a shoulder adjacent the lower edge of the head to engage retaining pins journalled through the stabilizer block such that the head is retained om the socket. The threaded shaft of the screw is threadedly secured through the threaded bore of the screw housing which is rigidly secured in the forearm stock by epoxy glue or the like.

The force between the rifle barrel and the forearm stock is adjusted by turning the screw which moves the stabilizer block relative to the stock and screw housing.

The primary object of the invention is to provide a simple device for varying the pressure between the rifle barrel and the forearm of the stock on the rifle to produce accurate shots with the rifle.

A still further object of the invention is to provice a stabilizing device which compensates for slight warpages in the stock which may occur due to weather conditions.

Another object of the invention is to provide a device which minimizes the number of parts and volume required to install the device on the typical rifle without altering the external contours and shape of the rifle forearm.

Other and further objects of the invention will become apparent upon referring to the detailed description hereinafter following and the drawings annexed hereto.

DESCRIPTION OF THE DRAWINGS

Drawings of a preferred embodiment of the invention are annexed hereto so that the invention may be better and more fully understood, in which.

Numeral references are employed to designate parts of the drawings and like numerals designate like parts throughout the various figures of the drawings.

DESCRIPTION OF A PREFERRED EMBODIMENT

Figure 1:
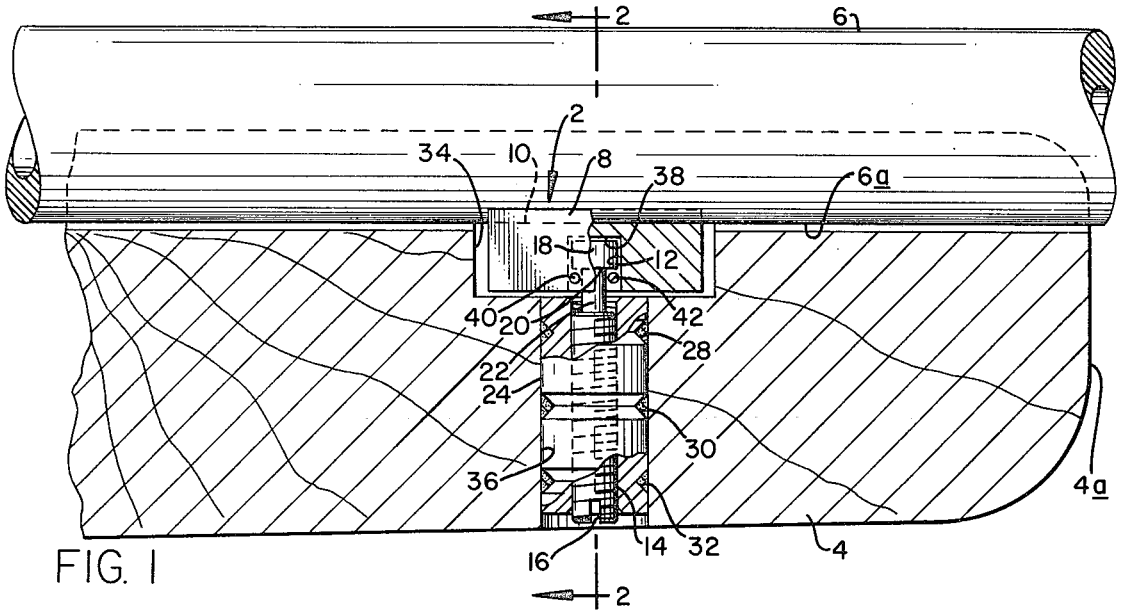
FIG. 1 is a side elevational view of the rifle barrel stabilizer installed with parts broken away to more clearly illustrate the details of construction.

Referring to FIG. 1 of the drawings, the rifle barrel stabliizer is generally designated by the numeral 2 and is rigidly secured in the stock forearm 4 just below the rifle barrel 6.

The stabilizer 2 comprises a stabilizing block 8 generally rectangular in shape and having a cove or concave groove 10 formed longitudinally in the upper surface thereof. The concave groove 10 engages the lower sides 6a of the rifle barrel such that the block contacts continuously along the barrel within the width of the block.

Figure 2:
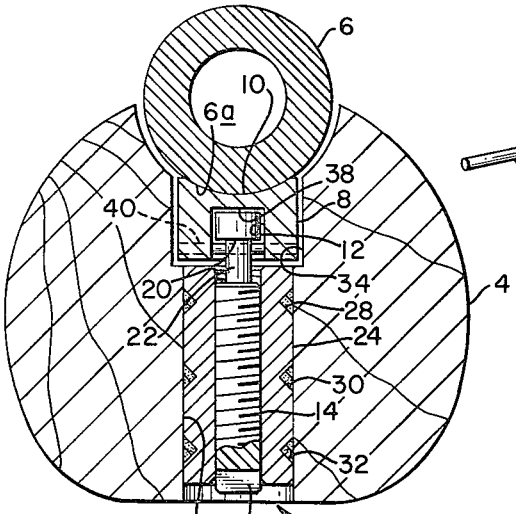
FIG. 2 is a cross-sectional view taken along line 2—2 of FIG. 1.
Figure 4:
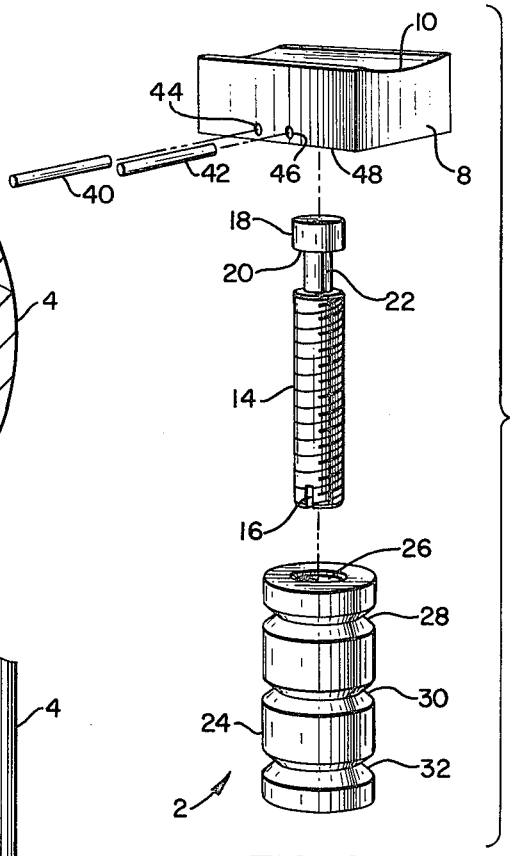
FIG. 4 is an exploded perspective view of the rifle barrel stabilizer detached from the stock and rifle.

As best illustrated in FIGS. 1 and 2, the stabilizer block 8 has a cavity 12 formed centrally in the lower surface 48 of block 8.

A threaded screw 14 has a slot 16 formed on one end and a head 18 formed at the other end. A portion 22 of the shaft of the screw is reduced in diameter to form a shoulder 20 adjacent to lower side of head 18 of the screw 14.

A screw housing 24 is formed of a cylindrical member having a threaded bore 26 formed longitudinally therein and having annular grooves 28, 30 and 32 formed on the exterior surface thereof. As best illustrated in FIGS. 1 and 2, a recess 34 is formed in the stock forearm 4 to allow positioning of stabilizer block 8 therein. A counterbore 36 is formed in the forearm stock 4 which communicates with recess 34. Screw housing 24 is rigidly secured in counterbore 36 by adhesives such as epoxy glue. Grooves 28, 30, and 32 provide an annular area for glue to adhere to the sides of the stock 4 to assure rigid mounting and reduce the size of counterbore 36.

Screw 14 is threaded through threaded bore 26 of screw housing 24 and head 18 engages the back surface 38 of cavity 12. Retaining pins 40 and 42 are journalled through apertures 44 and 46 formed transversely across the lower edge 48 of block 8 through opposite sides of cavity 12 such that pins 40 and 42 are positioned under shoulder 20 of screw 14 to limit movement of screw 14 outwardly from the cavity 12.

The stock and stock forearm are secured to the butt end of the rifle (not shown) in a standard method of thread screws through the stock and/or trigger guard depending on the type and manufacture of the rifle. This means the stabilizer pivots the barrel away from the stock.

Figure 3:
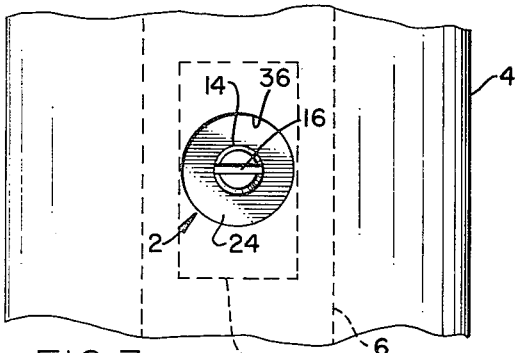
FIG. 3 is a bottom plan view thereof.

It should be readily apparent from the foregoing that turning screw 14 by engaging with a screwdriver in slot 16 in a clockwise direction, as viewed in FIG. 3, will move screw 14 upwardly relative to screw housing 24, thus increasing the force of stabilizer block 8 on the lower side 6*a* o barrel 6. Movement of screw 14 in the counterclockwise direction, as viewed in FIG. 3, would move screw 14 downwardly relative to housing 24, thus decreasing the force exerted between the stabilizer block and lower edge 6*a* of barrel 6.

It should also be readily apparent that groove 10 allows for continuous contact with the entire area of the barrel covered by stabilizer block 8 thus reducing the chance of wear of the barrel. The radius of groove 10 of block 8 may be varied for different rifle barrels.

It should be appreciated that this device requires no special tools to adjust the device and requires a minimal space be cut of the stock for installation of same.

The device is normally installed within one inch of the end 4*a* of the stock 4 for best results. Threads on the screw 14 should be fine enough to allow versatility of adjustment and yet large enough to withstand the shock and vibration of the barrel as the cartridge is fired. For instance, a prototype manufactured used 28 threads per inch on a ¼ inch machine screw.

From the foregoing it should be readily apparent that the embodiment hereinbefore described accomplishes the objects of the invention hereinbefore discussed.

It should be appreciated that other and further embodiments of the invention may be devised without departing from the basic concept thereof.

Having described my invention, I claim:

1. In a device for adjusting the force between a rifle barrel and rifle stock forearm; a stabilizer block having a longitudinal concaved groove formed in one side of said block, said concaved groove having a radius equal to the radius of the rifle barrel; a downwardly depending threaded screw; means rotatably securing said threaded screw to said block; and a screw housing secured in said stock forearm, said screw housing having a threaded bore to receive said threaded screw such that turning the screw within said threaded bore moves the screw and block relative to the forearm to adjust the force between the forearm and the rifle barrel.

2. The combination called for in claim 1 wherein the means rotatably securing said threaded screw comprises: a head formed on said screw, said screw being reduced in diameter adjacent said head to form a shoulder, said head being positioned in a cavity formed centrally in the lower surface of said block; and retaining members journalled through said block to engage opposite sides of the shoulder formed by said head on said screw to retain said head in said cavity.

3. The combination called for in claim 2 wherein the retaining members are pins.

4. The combination called for in claim 1 wherein said screw housing has grooves formed about the exterior surface thereof.

5. The combination called for in claim 1 wherein the screw housing is cylindrical in shape.

6. In a device for adjusting the force between a rifle barrel and rifle stock forearm: a stabilizer block, said block having a concaved groove formed longitudinally in the surface of said block adjacent the rifel barrel such that the lower surface of the barrel engages said concaved groove, said block further having a socket formed in the surface adjacent the stock forearm; a screw; said screw having a shoulder formed on one end thereof and a slot on the opposite end thereof, said shoulder on said screw being positioned in said socket of said block such that the screw depends downward from the block; retaining means positioned under said shoulder in said socket to limit movement of the screw out of the socket; and a screw housing, said screw housing having a threaded bore formed longitudinally thereof, said screw housing being secured to said stock forearm such that the threaded bore is axially aligned with the screw such that movement of the screw within the threaded bore moves the block relative to the stock forearm to vary the force between the barrel and stock forearm.

* * * * *